US008438736B2

(12) United States Patent
Keene et al.

(10) Patent No.: US 8,438,736 B2
(45) Date of Patent: May 14, 2013

(54) SAFETY RAZOR WITH IMPROVED GUARD

(75) Inventors: Andrew Russell Keene, Stoneham, MA (US); Cheryl Ann Fitzgerald, Reading, MA (US); Brian Patrick Watson, Albion, RI (US)

(73) Assignee: The Gillette Company, Boston, MA (US)

( * ) Notice: Subject to any disclaimer, the term of this patent is extended or adjusted under 35 U.S.C. 154(b) by 375 days.

(21) Appl. No.: 11/895,340

(22) Filed: Aug. 24, 2007

(65) Prior Publication Data

US 2009/0049695 A1 Feb. 26, 2009

(51) Int. Cl.
*B26B 19/42* (2006.01)
*B26B 19/44* (2006.01)
*B26B 21/00* (2006.01)

(52) U.S. Cl.
USPC ..... 30/50; 30/34.2; 30/41.5

(58) Field of Classification Search ..... 30/34.2, 30/50, 41, 41.5, 527, 532, 346.1, 346.55, 30/346.56, 346.6, 346.61, 169
See application file for complete search history.

(56) References Cited

U.S. PATENT DOCUMENTS 4,586,255 A * 5/1986 Jacobson ..... 30/41
4,854,043 A * 8/1989 Chen ..... 30/50
4,976,028 A * 12/1990 Chen ..... 30/49
5,003,694 A * 4/1991 Chen ..... 30/49
5,056,222 A * 10/1991 Miller et al. ..... 30/77
5,092,042 A 3/1992 Miller et al.
5,185,927 A * 2/1993 Rivers ..... 30/50
5,313,705 A * 5/1994 Rivers et al. ..... 30/50
5,365,665 A 11/1994 Coffin
5,456,009 A * 10/1995 Wexler ..... 30/77
5,689,883 A * 11/1997 Ortiz et al. ..... 30/34.2
5,802,721 A * 9/1998 Wain et al. ..... 30/34.2
5,903,979 A * 5/1999 Oldroyd ..... 30/41
5,918,369 A * 7/1999 Apprille et al. ..... 30/47
5,953,819 A * 9/1999 Simms et al. ..... 30/34.2
6,026,577 A * 2/2000 Ferraro ..... 30/526
6,112,412 A 9/2000 Richard
6,167,625 B1 * 1/2001 King et al. ..... 30/34.2
6,305,084 B1 * 10/2001 Zucker ..... 30/50
6,412,176 B1 7/2002 Prochaska et al.
6,550,141 B1 * 4/2003 Rivers et al. ..... 30/50
6,568,084 B2 5/2003 McCool et al.
6,601,303 B2 * 8/2003 Gilder et al. ..... 30/50
6,655,028 B2 12/2003 Coffin
6,772,523 B1 * 8/2004 Richard et al. ..... 30/527

(Continued)

OTHER PUBLICATIONS

PCT International Search Report with Written Opinion dated Feb. 25, 2009 (14 pgs).

*Primary Examiner* — Ghassem Alie
*Assistant Examiner* — Bharat C Patel
(74) *Attorney, Agent, or Firm* — Ronald T. Sia; Kevin C. Johnson; Steven W. Miller

(57) ABSTRACT

A shaving blade unit has a plastic housing having a front portion and a rear portion and two side surfaces extending from the front portion to the rear portion. A shaving blade is disposed between the front portion and the rear portion and has a blade length extending along a blade axis. A guard is disposed at the front portion of the housing. The guard includes an elastomeric member forming at least one passage extending between an upper surface and a lower surface of the elastomeric member.

21 Claims, 6 Drawing Sheets

U.S. PATENT DOCUMENTS

| | | | | |
|---|---|---|---|---|
| 6,839,968 | B2 | 1/2005 | Brown et al. | |
| 6,941,659 | B2 * | 9/2005 | Gilder | 30/34.2 |
| 7,197,825 | B2 * | 4/2007 | Walker et al. | 30/77 |
| 2001/0029669 | A1 | 10/2001 | Ferraro et al. | |
| 2003/0046819 | A1 * | 3/2003 | Ferraro et al. | 30/527 |
| 2003/0204954 | A1 * | 11/2003 | Wain | 30/49 |
| 2003/0217470 | A1 * | 11/2003 | Follo et al. | 30/81 |
| 2004/0055156 | A1 * | 3/2004 | Brown, Jr. | 30/34.1 |
| 2004/0231161 | A1 * | 11/2004 | Coffin et al. | 30/50 |
| 2005/0223568 | A1 | 10/2005 | Walker et al. | |

* cited by examiner

SAFETY RAZOR WITH IMPROVED GUARD

FIELD OF THE INVENTION

This invention relates to safety razors and, more particularly, to safety razor cartridges having a guard.

BACKGROUND OF THE INVENTION

In recent years wet-shaving, so-called "safety razors" having a cartridge with various numbers of blades and a guard have been proposed in the patent literature and commercialized, as described e.g., in U.S. Pat. No. 5,787,586, which generally describes a type of design that has been commercialized as the three-bladed Mach III razor, and in U.S. Pat. No. 7,197,825, which generally describes a type of design that has been commercialized as the five-bladed Fusion razor, both by The Gillette Company. The guard is located forward of the blades and is used to stretch the skin and prepare hairs for shaving.

Some razors have guards with larger contact areas to increase skin stretching and hair preparation by providing greater numbers of skin stretching elements, such as surfaces, fins, ribs, fingers, or the like. But shave prep and/or shave debris may accumulate between the guard and the skin during one or more shaving strokes. Under one hypothesis, the accumulation restricts the guard from frictionally engaging the skin (i.e., drag) and may tend to lessen skin stretch to during each stroke. Skin stretching tends lead to better closeness buy forcing hairs to protrude farther from their follicles. Under another hypothesis. the accumulation may cause so-called "hydroplaning" of the cartridge, which is a lifting the cartridge blades away from the skin by the shave prep in between the guard and the skin, thereby potentially reducing the closeness of the shave. Guards with larger contact areas may experience more hydroplaning.

SUMMARY OF THE INVENTION

This invention relates to safety razors and, more particularly, to safety razor cartridges having a guard.

In one aspect, the invention features, in general, a shaving blade unit having a plastic housing with a front portion and a rear portion and two side surfaces extending from the front portion to the rear portion. A shaving blade is disposed between the front portion and the rear portion and has a blade length extending along a blade axis. A guard is disposed at the front portion of the housing and includes an elastomeric member forming at least one passage extending between an upper surface and a lower surface of the elastomeric member.

In another aspect, the invention features, in general, a shaving razor having a handle and a shaving cartridge including connection structure connecting the cartridge to the handle. The shaving cartridge has a plastic housing with a front portion and a rear portion and two side surfaces extending from the front portion to the rear portion. A shaving blade is disposed between the front portion and the rear portion and has a blade length extending along a blade axis. A guard is disposed at the front portion of the housing. The guard has an elastomeric member forming at least one passage extending between an upper surface and a lower surface of the elastomeric member.

Certain implementations of the invention may include one or more of the following features. The passage is configured for fluidic communication between the upper surface and the lower surface. The elastomeric member has a leading portion extending beyond a leading edge of the plastic housing front portion and a following portion supported by the plastic housing front portion. The leading portion forms the at least one passage. The elastomeric member forms a channel in the upper surface extending from and in communication with the passage toward a front surface of the elastomeric member. The elastomeric member forms the channel in the front surface, the channel extending from the upper surface toward the lower surface. The elastomeric member has a wall member disposed on the upper surface and configured to direct shave prep into the passage. The elastomeric member forms multiple passages. The elastomeric member forms multiple channels in the upper surface, each channel extending from a respective passage toward a front surface of the elastomeric member. The elastomeric member comprises an elastomeric fin. The fin extends along a fin axis that is generally parallel to the blade axis, the fin having a length along the fin axis that is greater than or equal to the blade length. The elastomeric fin is made of a material having a Shore A hardness between about 30 and 60. The elastomeric member includes multiple elastomeric fins. The fins are arranged in parallel rows. the fins extending along respective fin axes that are parallel to the respective one or more blade axes, at least some of the fins having a length along an associated fin axis that is longer than the blade length. The shaving cartridge is permanently connected to the handle. The shaving cartridge is removably connected to the handle. The housing defines a connection structure adapted to connect the blade unit to the handle. The connecting structure is a bearing surface defining a pivot axis about which the plastic housing is pivotally supportable.

DETAILED DESCRIPTION OF THE INVENTION

Figure 1:
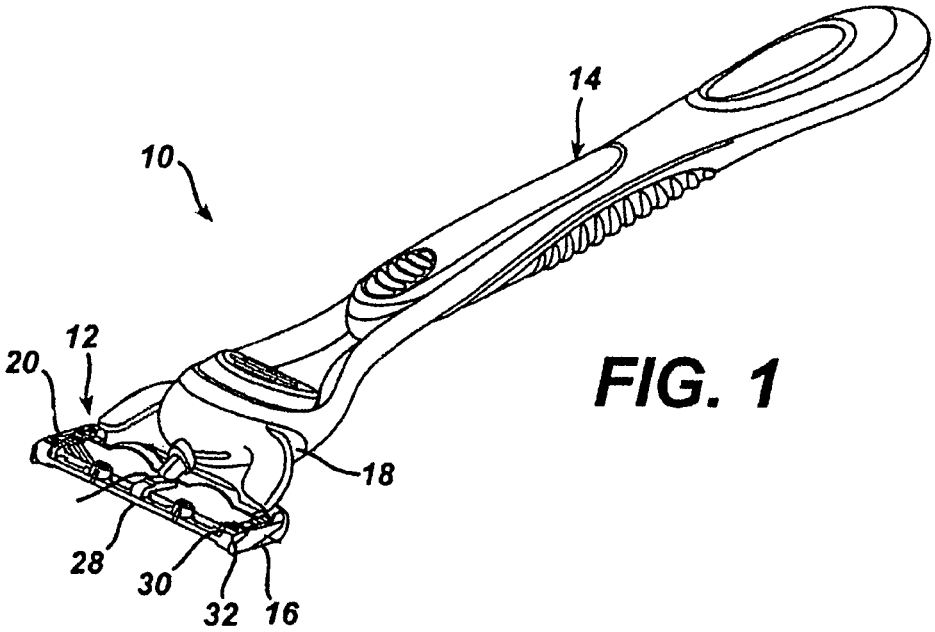
FIG. 1 is a perspective view of a razor.
Figure 2:
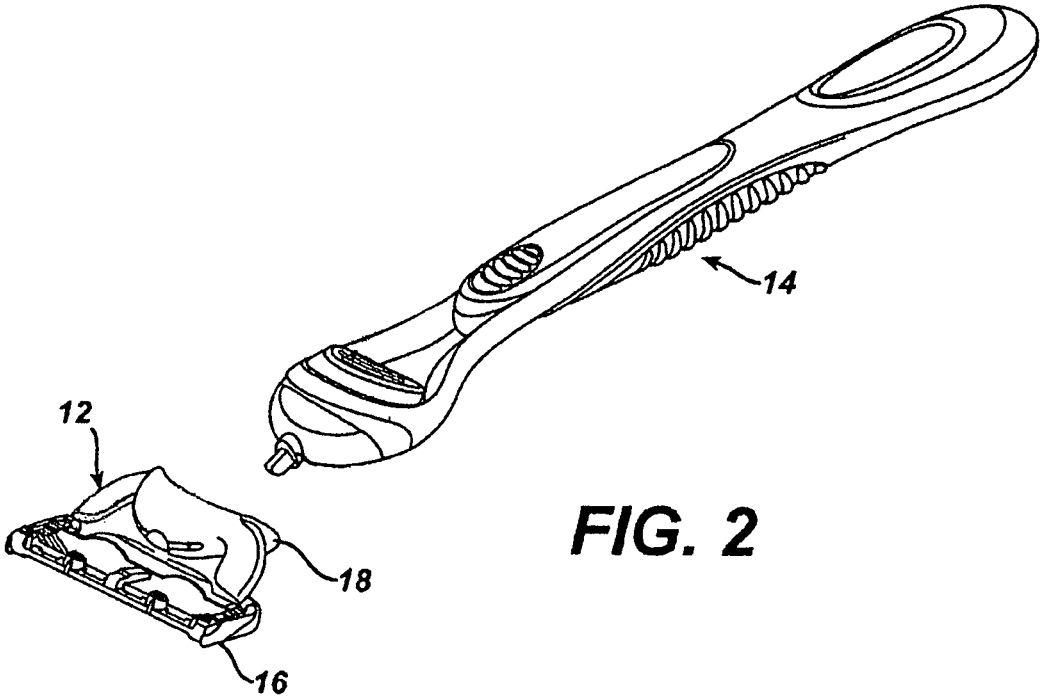
FIG. 2. is a perspective view of the razor of FIG. 1 with the cartridge disconnected from the handle.
Figure 3:
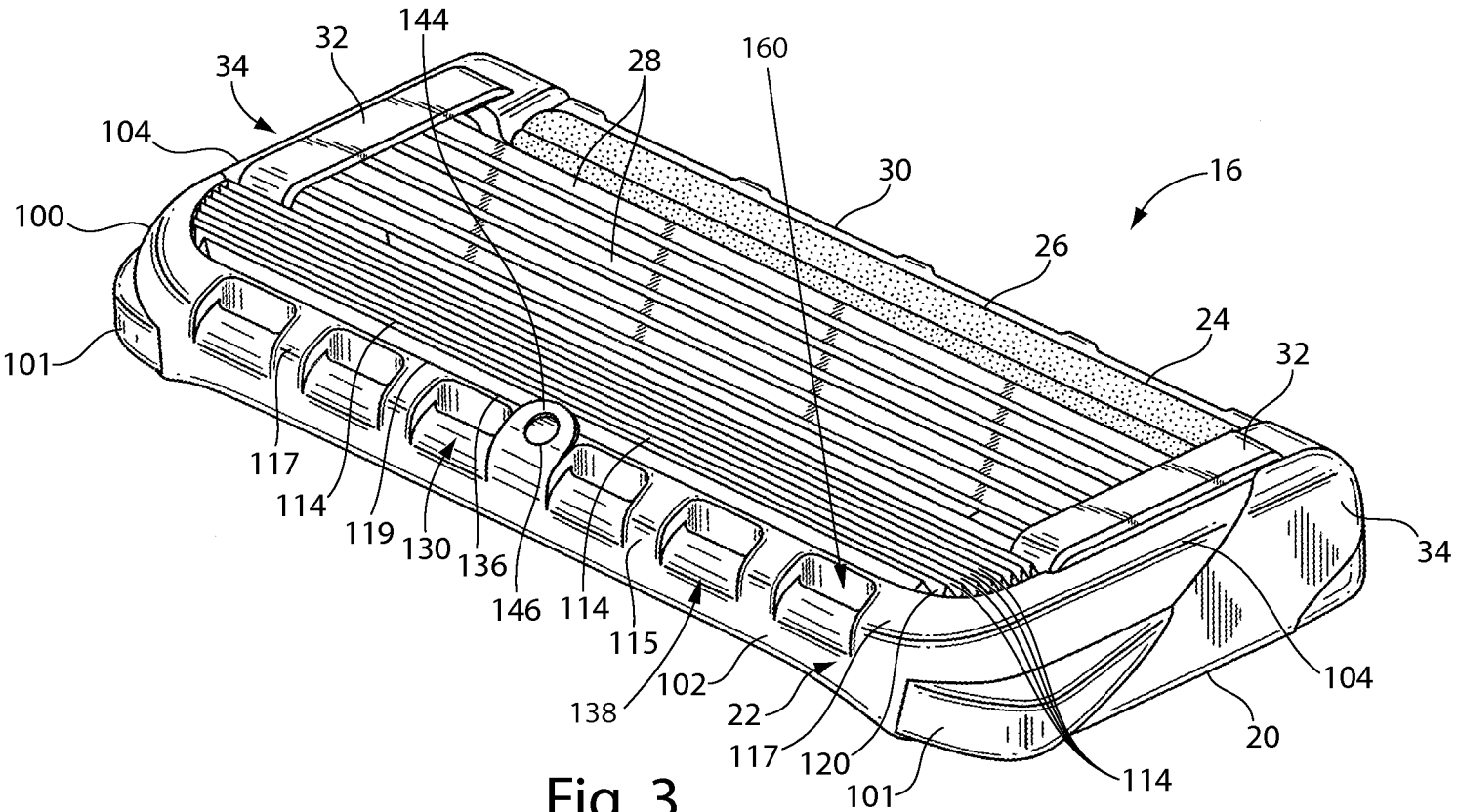
FIG. 3 is a perspective view of a blade unit of the razor of FIG. 1.

Referring to FIGS. 1-3, shaving razor 10 includes disposable cartridge 12 and handle 14. Cartridge 12 includes a connecting member 18, which removably connects cartridge 12 to handle 14, and a blade unit 16, which is pivotably connected to connecting member 18. The blade unit 16 includes plastic housing 20, guard 22 at the front of housing 20, cap 24 with lubricating strip 26 at the rear of housing 20, five blades 28 between guard 22 and cap 24, and trimming blade assembly 30 attached to the rear of housing 20 by clips 32, which also retain blades 28 within housing 20. Blades 28 are resiliently mounted within housing 20 as is well known in the art, for example being supported by resilient arms extending inwardly from the housing side walls.

Cap 24 provides a lubricious shaving aid and is received in a slot at the rear of housing 20. Cap 24 may be made of material comprising a mixture of hydrophobic material and a water leachable hydrophyllic polymer material, as is known in the art and described e.g., in U.S. Pat. Nos. 5,113,585 and 5,454,164 which are hereby incorporated by reference. Details of the cartridge as so far described can be found in U.S. Pat. No. 7,197,825, the entire contents of which are herein incorporated by reference.

Figure 4:
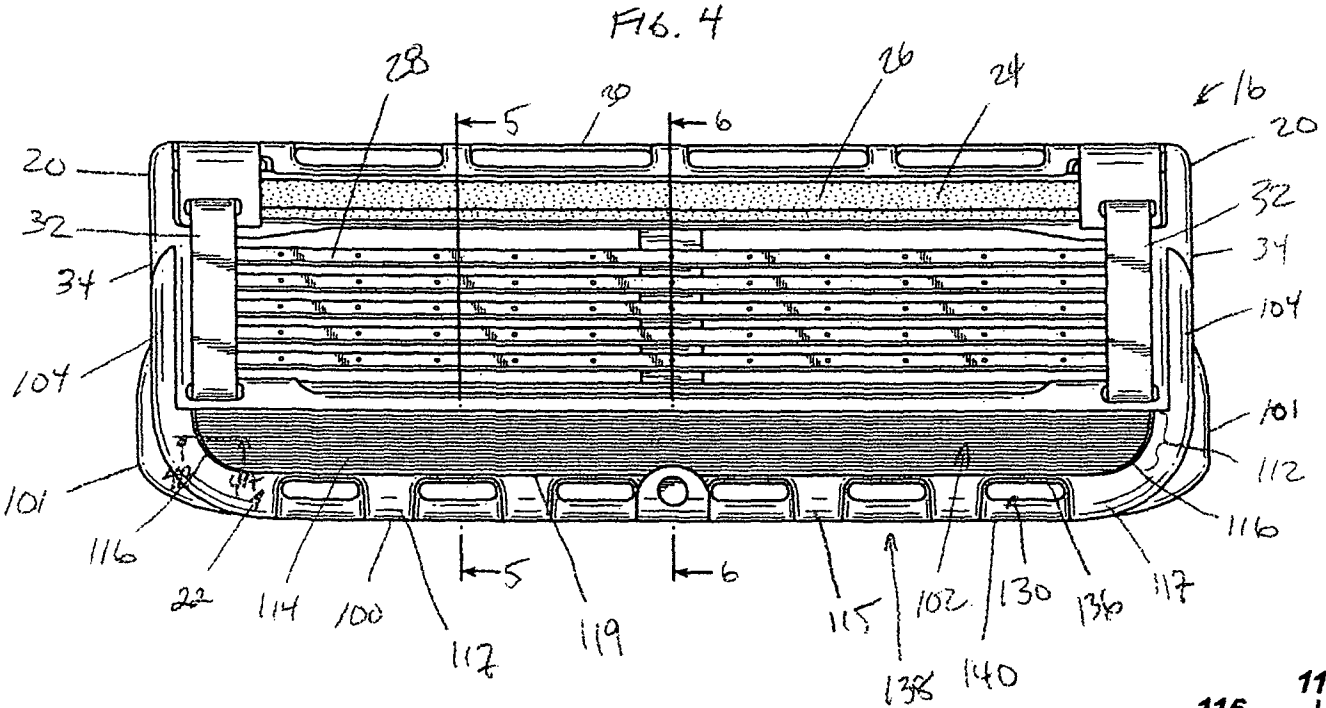
FIG. 4 is a top view of the blade unit of FIG. 1.
Figure 5:
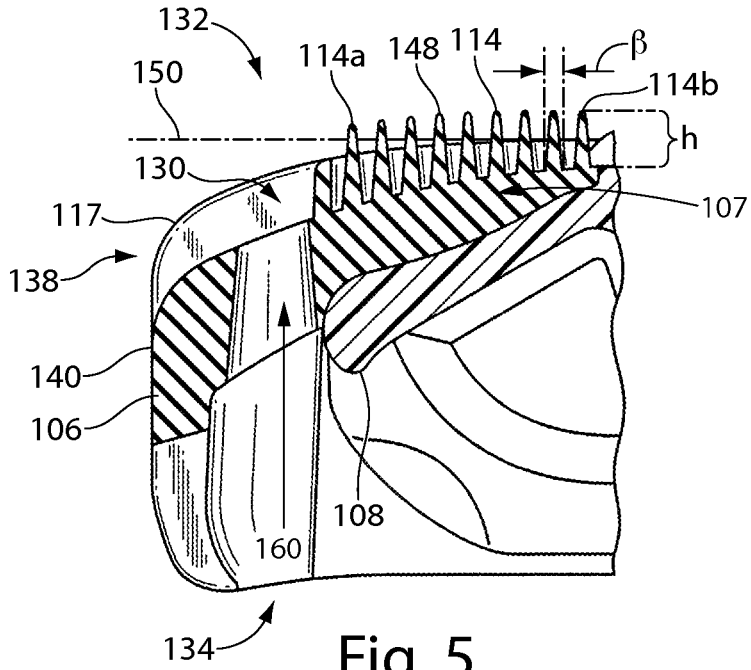

Referring to FIGS. 3-5, guard 22 includes a flexible elastomeric member 100 that extends to and over side surfaces 34. The elastomeric member 100 forms a projection 101 that is capable of mating with a dispenser (not shown) to secure the cartridge therein (e.g. for storage and/or shipping). Details of projection 101 can be found in pending U.S. application Ser. No. 10/798,140, filed on Mar. 11, 2004, and titled "Dispensers for Razor Blade Cartridges," the entire contents of which are incorporated herein by reference. The elastomeric member 100 includes a plurality of fins 114, discussed in detail below, that tend to stimulate and stretch the skin in front of blades 28, lifting and properly positioning the user's hairs for shaving.

Figure 6:
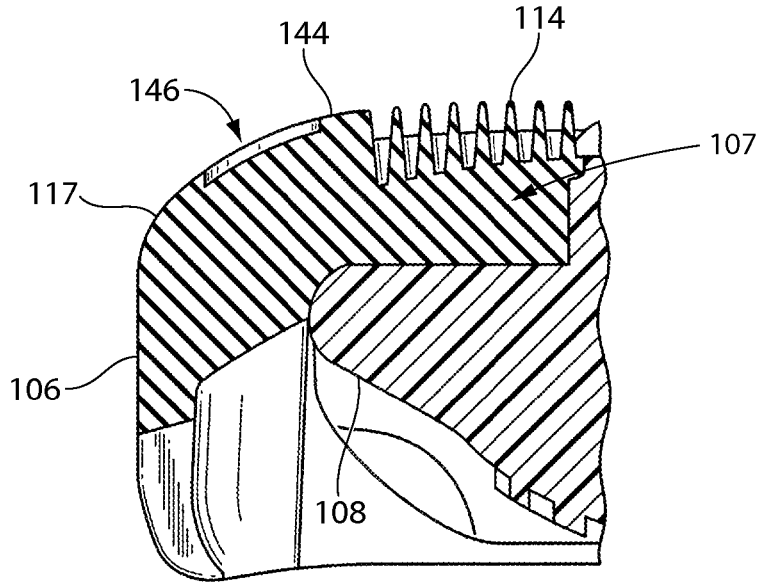

The elastomeric member 100 is supported along a rear portion 102 and side portions 104 by housing 20. Referring now to FIGS. 5 and 6, a front or leading portion of 106 of the elastomeric member 100 extends beyond a leading portion 108 of the housing 20 and is substantially unsupported by the housing 20 along its length. A following portion 107 of the elastomeric member 100 is supported by the leading portion 108. The leading portion 106 of the elastomeric member is relatively flexible and can deflect upon contact with a user's skin. In some cases, the leading portion 106 is of a sufficient flexibility to conform to a contour of a user's skin during use. This conformity to the user's skin will tend to increase the surface area of the elastomeric member that contact the user's skin, enhancing skin stretch, and will also tend to more uniformly distribute the force applied by the user during shaving.

Referring again to FIGS. 3-4, the elastomeric member 100 includes a group 112 of resilient fins, positioned within a frame 115. Frame 115 provides elastomeric surfaces 117 around the periphery of the fins, which may improve tracking of the cartridge during shaving, and may enhance the skin stretch and tactile properties provided by the elastomeric member. In some examples, surfaces 117 gradually increase toward blades 28 and terminate at an edge 119 below the height of fins 114. In other examples, edge 119 could be at the same or greater height than fins 114. In one example, surfaces 117 are relatively smooth, while in other examples, the surfaces could comprise fins, fingers, ribs, dimples or other skin engaging features as are well known in the art.

Figure 4A:
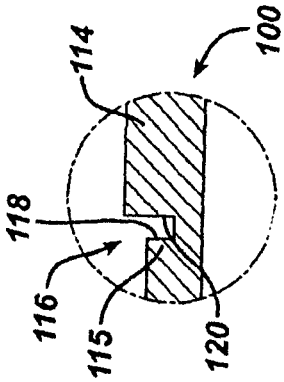
FIGS. 4A, 5 and 6 are partial section views of the guard of the blade unit of FIG. 1.

Referring also to FIG. 4A, a groove 116 is provided between a recessed wall 118 of the frame 115 and ends 120 of the fins 114. Groove 116 allows the fins to flex, for example close together when the leading portion 106 is deflected, rather than being fixed at their end as would be the case if the fins were joined to the frame 115 at their ends. However, if desired the fins can be joined to the frame, or the frame 115 can be omitted and the fins can extend the full length of the guard.

Referring to FIGS. 3-5, in some examples, elastomeric member 100 forms a series of ducts 130 for directing shave prep and/or shave debris away from the upper surface 132 of guard 22 toward lower surface 134. The ducts 130 are disposed toward the front of blade unit 16, preferably within frame 115, and preferably are aligned along an axis substantially parallel to blades 28. In other examples, ducts 130 may be aligned along an axis not parallel to blades 28 and/or may not all align along a single axis. Wiping members 136 are disposed rearwardly of one or more, preferably all, of ducts 130 for directing shave prep from the skin and into ducts 130. Wiping members 136 preferably extend upwardly to terminate at surfaces 117 of frame 115 but, in other examples, could extend above surfaces 117.

In some examples, elastomeric member 100 forms channels 138 in the upper surface 132 extending from one or more, preferably one for each of, ducts 130 to front wall 140 of member 100 for further directing shave prep into ducts 130. As elastomeric member 100 is moved along the skin during a shaving stroke, shave prep enters channels 138 and is wiped from the skin by wiping member 136. As wiped shave prep accumulates in channels 138, fresh shave prep entering channels 138 drives wiped shave prep rearwardly and through ducts 130, thereby reducing the shave prep between the skin and fins 114 and reducing the likelihood of hydroplaning.

Figure 7:
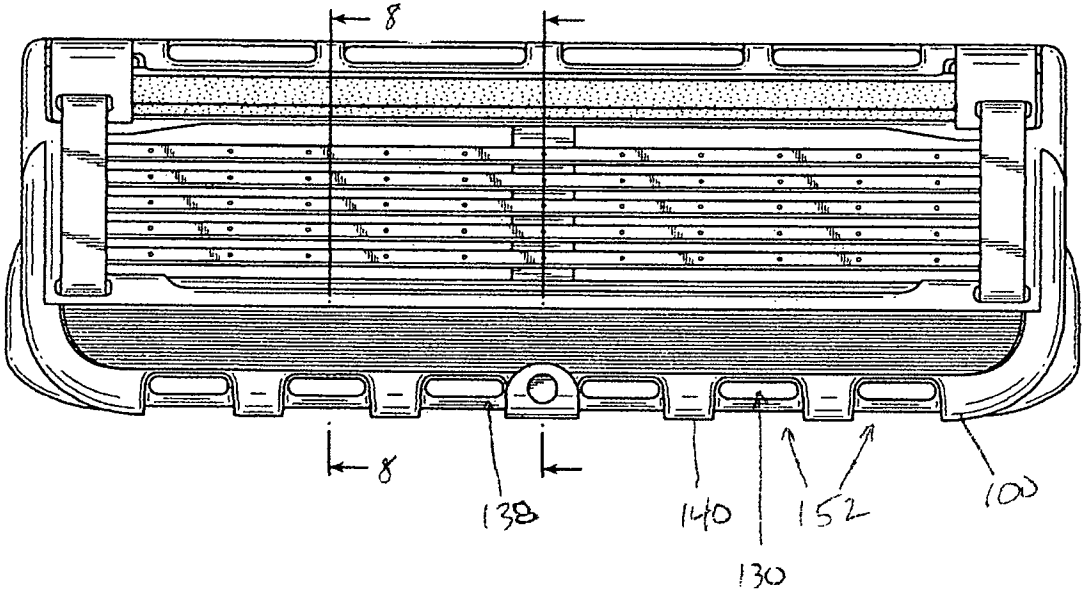
FIG. 7 is a top view of a blade unit having an alternative guard.
Figure 8:
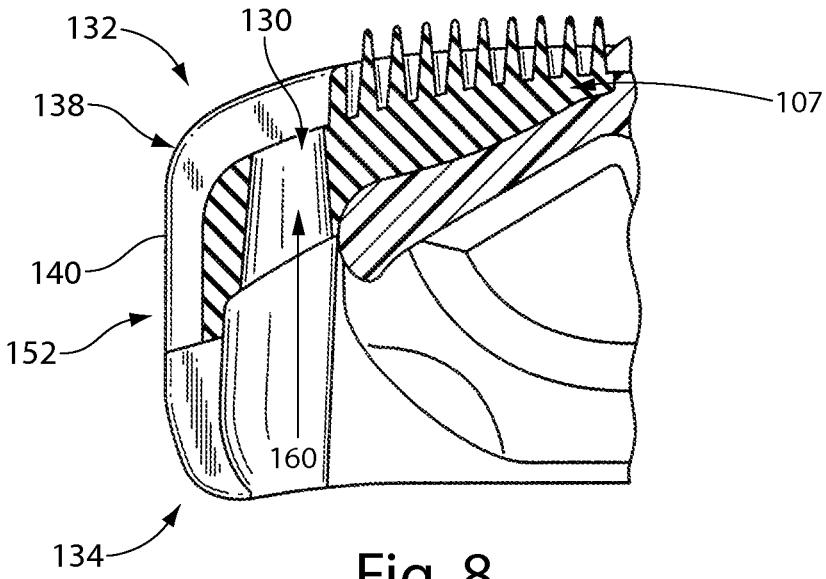
FIG. 8 is a partial section view of the guard of the blade unit of FIG. 7.

Referring to FIGS. 7 and 8, in some examples, elastomeric member 100 forms passages 160 in the front surface 140 of member 100 extending from upper surface 132 toward lower surface 134, each passage 160 in communication with a channel 138. As shave prep accumulates in channel 138, it may be forced through duct 130 or into passages 160 to further direct the shave prep away from upper surface 132.

In the embodiment shown, group 112 includes 9 fins. Generally, the elastomeric member may include fewer or more fins (e.g., between about 5 and 15 fins). For a given pitch and fin geometry, more fins will generally give greater skin stretch, for a closer shave; however, above a certain number of fins the skin stretch tends not to increase (or increased skin stretch is not necessary) and the elastomeric member may become overly wide, making it difficult for the user to shave in tight areas.

Referring back to FIG. 5, tips 148 of the elastomeric fins 114 increase in elevation from the fin furthest from the blades 28 to the fin closest to the blades 28 along a curve. All of the tips 120 lie above a plane 150 that passes through the cutting edges of the blades 28. The increasing elevation of fins 114 tends to gradually increase skin contact. The increasing elevation also causes the tips to conform to the skin during shaving. Fins 114 have a tip to base height "h" of 0.4 to 0.9 mm and a narrow profile, i.e., the fins define an included angle theta of less than about 14 degrees (preferably between about 8 and about 14 degrees, such as about 11 degrees). The fins 114 are spaced at a pitch of between about 0.14 and 0.57 mm center-to-center, e.g., 0.284 mm, and are between about 0.1 and 0.4 mm, e.g., 0.217 mm, thick at their bases. The distance from the front of the first fin 114*a* to the back of the last fin 114*b* at the base is about 2.75 mm. Alternatively, this distance can be between about 2.5 and 3.5 mm. The narrow, e.g., 8 to 14 degree fin profile beta improves fin flexibility, which helps stretch the skin, thereby setting up hairs for improved cutting.

The material for forming the elastomeric member 100 can be selected as desired. Preferably, the elastomeric member is formed of an elastomeric material, such as block copolymers (or other suitable materials), e.g., having a durometer between 28 and 60 Shore A. Preferably, fins 114 are also made of a relatively soft material, e.g., having a Shore A hardness of between about 28 and 60 (for example, between about 40 and 50, such as between about 40 and 45 Shore A). As values are increased above this range, performance may tend to deteriorate, and as values are decreased below this range there may be production problems. As shown, the fins and elastomeric member are integrally formed of the same material. In other cases, the fins and elastomeric member are formed of differing materials.

The manufacturing method for forming elastomeric member 100 can be selected as desired. Preferably, elastomeric member 100 is formed onto housing 20 by a two material injection molding process. Referring to FIGS. 6 and 8, in some examples, elevated pad 144 is disposed on frame 115 above surfaces 117 and forms a recess 146, which allows for placement of an injection molding gate that will promote material flow and mold filling while relieving gate remnants from skin contacting surfaces 117. Alternatively, elastomeric member 100 may be formed separately from housing 20 and subsequently attached thereto, by an adhesive, for example.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade unit comprising:

a plastic housing comprising a front portion and a rear portion and two side surfaces extending from the front portion to the rear portion;

at least one shaving blade disposed between the front portion and the rear portion and comprising a blade length extending along respective one or more parallel blade axes; and a guard formed of a single segment at the front portion of the housing, the guard comprising an elastomeric member comprising a leading portion which at least partially extends beyond the front portion of the plastic housing, wherein the portion of the leading portion extending beyond the front portion of the plastic housing forms a series of ducts aligned along said elastomeric member, said series of ducts forming at least one through hole extending between an upper surface through to a lower surface of the leading portion of the elastomeric member, wherein said upper surface of the leading portion of the elastomeric member forms a skin engaging surface with the tip of said at least one shaving blade, and said lower surface is opposite said upper surface, wherein said guard further comprises at least one elastomeric fin aft of said series of ducts, and said elastomeric member forms at least two channels in the upper surface, each of said channels extends from and in communication with the at least one duct of said series of ducts toward said leading portion of the elastomeric member.

2. The saving blade unit of claim 1, wherein said guard further forms a wiping member disposed rearwardly of said ducts and extending upwardly from said upper surface of the elastomeric member.

3. The shaving blade unit of claim 1, wherein the series of ducts are aligned along an axis substantially parallel to said at least one shaving blade.

4. The shaving blade unit of claim 1, wherein the elastomeric member further comprises at least one wall member disposed on the upper surface and configured to direct shaving prep into the at least one duct.

5. The shaving blade unit of claim 1, wherein the elastomeric member forms multiple ducts.

6. The shaving blade unit of claim 5, wherein the elastomeric member forms multiple channels in the upper surface, each channel extending from a respective passage toward a front surface of the elastomeric member.

7. The shaving blade unit of claim 1, wherein the fin extends along a fin axis that is generally parallel to the respective one or more blade axes, the fin having a length along the fin axis that is greater than or equal to the blade length.

8. The shaving blade unit of claim 7, wherein the elastomeric fin is made of a material having a Shore A hardness between about 30 and 60.

9. The shaving blade unit of claim 8, wherein the elastomeric member includes multiple elastomeric fins.

10. The shaving blade unit of claim 9, wherein the fins are arranged in parallel rows, the fins extending along respective fin axes that are parallel to the respective one or more blade axes, at least some of the fins having a length along an associated fin axis that is longer than the blade length.

11. The shaving razor of claim 1, wherein said lower surface of the elastomeric member is the lower surface of the guard, allowing shaving preparation to be directed below the cartridge.

12. The shaving razor of claim 1, wherein said housing forms a plane that passes through the cutting edge of said at least one shaving blade, and said upper surface is positioned intermediate between said plane and said lower surface.

13. The shaving razor of claim 12, wherein said duct extends perpendicularly away from said plane.

14. The shaving razor of claim 1, wherein said upper surface and said lower surface do not form parallel planes.

15. The shaving razor of claim 1, wherein said series of ducts are for directing shave prep and/or shave debris away from the upper surface through the lower surface.

16. A shaving razor comprising:

a handle; and a shaving cartridge including connection structure connecting the cartridge to the handle, the shaving cartridge comprising:

a plastic housing comprising a front portion and a rear portion and two side surfaces extending from the front portion to the rear portion at least one shaving blade disposed between the front portion and the rear portion and comprising a blade length extending along respective one or more parallel blade axes; and a guard formed of a single segment at the front portion the housing, the guard comprising an elastomeric member comprising a leading portion which at least partially extends beyond the front portion of the plastic housing, wherein the portion of the leading portion extending beyond the front portion of the plastic housing forms a series of ducts aligned along said elastomeric member, said series of ducts forming at least one through hole extending between an upper surface through to a lower surface of the elastomeric member, wherein said upper surface of the leading portion of the elastomeric member forms a skin engaging surface with the tip of said at least one shaving blade, and said lower surface is opposite said upper surface wherein said guard further comprises at least one fin aft of said series of ducts, and said elastomeric member forms at least two channels in the upper surface, each of said channels extends from and in communication with the at least one duct of said series of ducts toward said leading portion of the elastomeric member.

17. The shaving razor of claim 16, wherein the shaving cartridge is permanently connected to the handle.

18. The shaving razor of claim 16, wherein the shaving cartridge is removably connected to the handle.

19. The shaving razor of claim 16, wherein the housing defines a connection structure adapted to connect the blade unit to the handle.

20. The shaving razor of claim 19, wherein the connecting structure is a bearing surface defining a pivot axis about which the plastic housing is pivotally supportable.

21. A shaving blade unit comprising:

a plastic housing comprising a front portion and a rear portion;

at least one shaving blade disposed between the front portion and the rear portion; and a guard at the front portion of the housing, the guard consisting essentially of a elastomeric member comprising:

a leading portion which at least partially extends beyond the front portion of the plastic housing, wherein the portion of the leading portion extending beyond the front portion of the plastic housing forms a series of ducts aligned along said elastomeric member, said series of ducts forming at least one through hole between an upper surface and a lower surface of the member, wherein said upper surface of the leading portion of the elastomeric member forms a skin engaging surface with the tip of said at least one shaving blade, and said lower surface is opposite said upper surface; and a rear portion forming at least one elastomeric fin extending along a fin axis that is parallel to a respective axis of said shaving blade and having a fin length that is longer than the blade length, wherein said elastomeric member forms at least two channels in the upper surface, each of said channels extends from and in communication with the at least one duct of said series of ducts toward said leading portion of the elastomeric member.

* * * * *